US010453299B2

(12) United States Patent
Boesen et al.

(10) Patent No.: US 10,453,299 B2
(45) Date of Patent: Oct. 22, 2019

(54) METHOD OF ENABLING RESTORATION OF GAMES AND A METHOD OF RESTORING GAMES

(75) Inventors: John Leslie Boesen, Menai (AU); Chi We Chim, Beecroft (AU)

(73) Assignee: ARISTOCRAT TECHNOLOGIES AUSTRALIA PTY LIMITED, North Ryde, NSW (AU)

( * ) Notice: Subject to any disclaimer, the term of this patent is extended or adjusted under 35 U.S.C. 154(b) by 989 days.

(21) Appl. No.: 12/976,639

(22) Filed: Dec. 22, 2010

(65) Prior Publication Data

US 2011/0151979 A1 Jun. 23, 2011

(30) Foreign Application Priority Data

Dec. 23, 2009 (AU) ..... 2009906270

(51) Int. Cl.
*G07F 17/32* (2006.01)

(52) U.S. Cl.
CPC ..... *G07F 17/3239* (2013.01); *G07F 17/32* (2013.01); *G07F 17/3218* (2013.01); *G07F 17/3241* (2013.01); *G07F 17/3255* (2013.01)

(58) Field of Classification Search
CPC .. G07F 17/32; G07F 17/3213; G07F 17/3225; G07F 17/326; G07F 17/3227; G07F 17/3218; G07F 17/3241; G07F 17/3255
USPC ..... 463/29, 39–43, 24; 273/138.1, 139
See application file for complete search history.

(56) References Cited

U.S. PATENT DOCUMENTS 6,364,765 B1 * 4/2002 Walker ..... G07F 17/32 463/16
6,811,486 B1 * 11/2004 Luciano, Jr. ..... G07F 17/3239 273/459
6,884,172 B1 * 4/2005 Lloyd ..... A63F 13/12 463/40
6,923,721 B2 8/2005 Luciano et al.
7,182,690 B2 * 2/2007 Giobbi et al. ..... 463/24
7,367,888 B1 * 5/2008 Chen ..... A63F 13/12 463/1
7,370,190 B2 * 5/2008 Calhoon ..... G06F 21/16 713/2
7,584,154 B1 * 9/2009 Chen ..... G06Q 10/10 463/42
7,811,167 B2 10/2010 Giobbi et al.
(Continued)

FOREIGN PATENT DOCUMENTS

CN 101015738 8/2007
CN 101310310 11/2008
(Continued)

*Primary Examiner* — Chase E Leichliter
(74) *Attorney, Agent, or Firm* — Armstrong Teasdale LLP

(57) ABSTRACT

There is disclosed a method for enabling restoration of games. The method comprises receiving a request for subsequent restoration of a game at a gaming device, selecting one of a plurality of game state identifiers associated with respective ones of a plurality of game states based on a current game state presented at the gaming device, and issuing the game state identifier. There is also disclosed a method for restoring games. The method comprises receiving a game state identifier, and restoring a game at a gaming device to one of a plurality of game states associated with respective ones of a plurality of game state identifiers based on the game state identifier.

17 Claims, 9 Drawing Sheets

(56) References Cited

U.S. PATENT DOCUMENTS 8,313,371 B1* 11/2012 Luciano, Jr. ..... G07F 17/32 273/138.1
8,371,919 B2 2/2013 Hornik et al.
8,574,062 B2 11/2013 Giobbi et al.
9,293,001 B2 3/2016 Anderson et al.
2001/0034263 A1 10/2001 Roberts
2001/0046893 A1 11/2001 Gobbi
2002/0094871 A1 7/2002 Luciano, Jr.
2003/0073494 A1* 4/2003 Kalpakian ..... G07F 17/32 463/42
2003/0104857 A1 6/2003 Jenkins
2003/0199310 A1 10/2003 Kaminkow
2004/0002384 A1* 1/2004 Multerer ..... A63F 13/12 463/42
2004/0176157 A1* 9/2004 Walker et al. ..... 463/16
2004/0219967 A1 11/2004 Gobbi
2005/0227753 A1 10/2005 Luciano, Jr.
2005/0265373 A1 12/2005 Khan
2006/0058103 A1 3/2006 Danieli
2006/0105836 A1* 5/2006 Walker et al. ..... 463/25
2006/0111186 A1 5/2006 Hattori
2006/0189382 A1 8/2006 Muir
2007/0010309 A1 1/2007 Giobbi
2007/0021198 A1 1/2007 Muir
2007/0026916 A1* 2/2007 Juds ..... G07F 7/005 463/1
2007/0117623 A1* 5/2007 Nelson ..... G06Q 30/02 463/29
2007/0155490 A1 7/2007 Phillips
2007/0259713 A1 11/2007 Fiden
2008/0026853 A1 1/2008 Crowder, Jr.
2008/0087521 A1 4/2008 Cole
2008/0090650 A1 4/2008 Tarantino
2008/0163055 A1* 7/2008 Ganz ..... G06Q 30/0643 715/706
2008/0234044 A1 9/2008 Aida
2008/0234047 A1* 9/2008 Nguyen ..... G07F 17/32 463/42
2008/0274792 A1* 11/2008 Walker et al. ..... 463/25
2008/0300049 A1* 12/2008 Anderson et al. ..... 463/25
2009/0054136 A1* 2/2009 Gagner ..... G07F 17/3248 463/25
2009/0074191 A1 3/2009 Gatto
2009/0087076 A1* 4/2009 Jenrick ..... G07D 7/00 382/135
2009/0104968 A1 4/2009 Englman
2009/0124376 A1* 5/2009 Kelly ..... G07F 17/3206 463/29
2009/0189895 A1 7/2009 James
2009/0203433 A1 8/2009 Olivas
2009/0275402 A1* 11/2009 Backover ..... G07F 17/3239 463/29
2010/0167810 A1* 7/2010 Fitzsimons et al. ..... 463/25
2010/0240442 A1* 9/2010 Anderson ..... G07F 17/32 463/24
2010/0285878 A1* 11/2010 Tarantino ..... 463/36
2011/0111835 A1* 5/2011 Cohen ..... G07F 17/3244 463/25
2012/0004026 A1* 1/2012 Vann ..... G06Q 30/02 463/25

FOREIGN PATENT DOCUMENTS

EP 1705564 9/2006
EP 1890231 2/2008
GB 2443264 4/2008
IE 950162 9/1995
JP 2009061344 3/2009
JP 2009061345 3/2009
JP 2009061346 3/2009
JP 2009061347 3/2009
JP 2009061348 3/2009
MX 2007010957 11/2007
MX 2007011042 11/2007
NL 1016736 5/2002
SG 136965 11/2007
WO 0105477 1/2001
WO 0120489 3/2001
WO 0176708 10/2001
WO 2004014502 2/2004
WO 2006098931 9/2006
WO 2007014000 2/2007
WO 2007075380 7/2007
WO 2007086779 8/2007
WO 2008050146 5/2008

* cited by examiner

METHOD OF ENABLING RESTORATION OF GAMES AND A METHOD OF RESTORING GAMES

CROSS REFERENCE TO RELATED APPLICATIONS

The present application relates to and claims the benefit of priority from Australian Provisional Patent Application Number 2009906270, filed on Dec. 23, 2009, which is herein incorporated by reference in its entirety.

FIELD

The present invention relates to a method of enabling restoration of games, a method of restoring games, a game controller, a gaming machine and a gaming system.

BACKGROUND

Some electronic wagering games unlock game features as a player progresses through different stages. Such games may require significant amount of game play to progress through the different stages to unlock the game features. Accordingly, a player who decides to cash out may be discouraged from playing the same game again because the player has to go through the same stages to unlock the same game features.

There is thus a need to enable a player to save a game.

BRIEF SUMMARY

In a first aspect, the invention provides a method for enabling restoration of games, comprising:

receiving a request for subsequent restoration of a game at a gaming device;

selecting one of a plurality of game state identifiers associated with respective ones of a plurality of game states based on a current game state presented at the gaming device; and issuing the game state identifier.

In an embodiment, each game state corresponds to a stage of the game.

In an embodiment, each game state is associated with a game state identifier by mapping the game state to the game state identifier.

In an embodiment, issuing the game state identifier comprises printing a ticket comprising the game state identifier.

In an embodiment, issuing the game state identifier comprises transmitting a Short Messaging Service (SMS) message comprising the game state identifier.

In an embodiment, the method further comprises:

making a request for a session identifier from a server; and issuing the session identifier.

In a second aspect, the invention provides a game controller for a gaming device, the game controller configured to:

receive a request for subsequent restoration of a game at the gaming device;

select one of a plurality of game state identifiers associated with respective ones of a plurality of game states based on a current game state presented at the gaming device; and issue the game state identifier.

In an embodiment, each game state corresponds to a stage of the game.

In an embodiment, each game state is associated with a game state identifier by a game mapper configured to map a game state to a game state identifier.

In an embodiment, the game controller is further configured to communicate with a ticket printer for printing a ticket comprising the game state identifier.

In an embodiment, the game controller is further configured to communicate with an identifier transmitter for transmitting a Short Messaging Service (SMS) message comprising the game state identifier.

In an embodiment, the game controller is further configured to:

make a request for a session identifier from a server; and issue the session identifier.

In a third aspect, the invention provides a method for restoring games, comprising:

receiving a game state identifier; and restoring a game at a gaming device to one of a plurality of game states associated with respective ones of a plurality of game state identifiers based on the game state identifier.

In an embodiment, each game state corresponds to a stage of the game.

In an embodiment, each game state is associated with a game state identifier by mapping the game state to the game state identifier.

In an embodiment, receiving a game state identifier comprises reading a ticket comprising the game state identifier.

In an embodiment, receiving a game state identifier comprises receiving input comprising the game state identifier.

In an embodiment, the method further comprises:

communicating a session identifier to a server; and receiving a communication in respect of whether the session identifier has been used previously to restore a game.

In a fourth aspect, the invention provides a game controller for a gaming device, the game controller configured to:

receive a game state identifier; and restore a game at the gaming device to one of a plurality of game states associated with respective ones of a plurality of game state identifiers based on the game state identifier.

In an embodiment, a game state corresponds to a stage of the game.

In an embodiment, each game state is associated with a game state identifier by a game mapper configured to map a game state to a game state identifier.

In an embodiment, the game controller is further configured to communicate with a ticket reader for reading a ticket comprising the game state identifier.

In an embodiment, the game controller is further configured to communicate with a keypad for receiving input comprising the game state identifier.

In an embodiment, the game controller is further configured to:

communicate with an interface for communicating a session identifier to a server; and receive a communication in respect of whether the session identifier has been used previously to restore a game.

In a fifth aspect, the invention provides a gaming system comprising:

a display for presenting play of a game to a player; and a game controller configured to:

receive a request for subsequent restoration of a game;

select one of a plurality of game state identifiers associated with respective ones of a plurality of game states based on a current game state presented at the gaming system; and issue the game state identifier.

In a sixth aspect, the invention provides a gaming system comprising:

a display for presenting play of a game to a player; and a game controller configured to:

receive a game state identifier; and restore the game to one of a plurality of game states associated with respective ones of a plurality of game state identifiers based on the game state identifier.

In a seventh aspect, the invention provides a gaming machine comprising:

a cabinet;

a display mounted within the cabinet for presenting play of a game to a player;

one or more input devices operable by a player to place a wager and initiate play of the game; and a game controller in data communication with the one or more input devices and the display, the game controller comprising a processor arranged to execute program code stored in a memory in order to conduct the game in response to operation of the one or more input devices, the program code including instructions such that in at least occasionally, the game controller, will as part of game play:

receive a request for subsequent restoration of the game;

select one of a plurality of game state identifiers associated with respective ones of a plurality of game states based on a current game state presented at the gaming machine; and issue the game state identifier.

In an eighth aspect, the invention provides a gaming machine comprising:

a cabinet;

a display mounted within the cabinet for presenting play of a game to a player;

one or more input devices operable by a player to place a wager and initiate play of the game; and a game controller in data communication with the one or more input devices and the display, the game controller comprising a processor arranged to execute program code stored in a memory in order to conduct the game in response to operation of the one or more input devices, the program code including instructions such that in at least occasionally, the game controller, will as part of game play:

receive a game state identifier; and restore the game to one of a plurality of game states associated with respective ones of a plurality of game state identifiers based on the game state identifier.

In a ninth aspect, the invention provides a gaming system comprising:

means for displaying play of a game to a player;

means for receiving a request for subsequent restoration of the game;

means for selecting one of a plurality of game state identifiers associated with respective ones of a plurality of game states based on a current game state presented at the gaming system; and means for issuing the game state identifier.

In a tenth aspect, the invention provides a gaming system comprising:

means for displaying play of a game to a player;

means for receiving a game state identifier;

means for restoring the game to one of a plurality of game states associated with respective ones of a plurality of game state identifiers based on the game state identifier.

In an eleventh aspect, the invention provides a game controller for a gaming system, comprising:

a restoration request receiver arranged to receive a request for subsequent restoration of a game at the gaming device;

a game state identifier selector arranged to select one of a plurality of game state identifiers associated with respective ones of a plurality of game states based on a current game state presented at the gaming device; and a game state issuer arranged to issue the game state identifier.

In a twelfth aspect, the invention provides a game controller for a gaming system, comprising:

a game state receiver arranged to receive a game state identifier; and a game state restorer arranged to restore a game at the gaming device to one of a plurality of game states associated with respective ones of a plurality of game state identifiers based on the game state identifier.

In a thirteenth aspect, the invention provides computer program code which when executed implements any one of the above methods.

In a fourteenth aspect, the invention provides a tangible computer readable medium comprising the above computer program code.

In a fifteenth aspect, the invention provides a data signal comprising the above computer program code.

In a sixteenth aspect, the invention provides transmitting or receiving the above computer program code.

BRIEF DESCRIPTION OF DRAWINGS

Certain exemplary embodiments of the invention will now be described with reference to the accompanying drawings in which.

Figure 1:
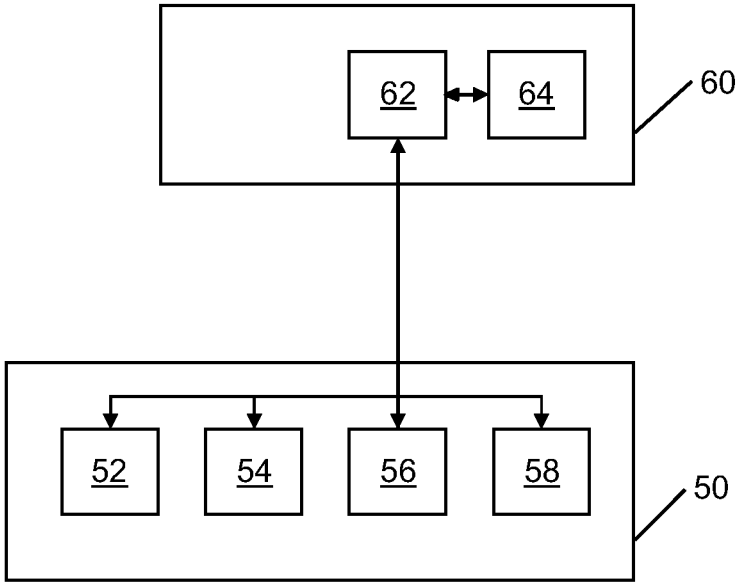
FIG. 1 is a block diagram of the core components of a gaming device.

Features, further aspects, and advantages of the present invention will become apparent from the following description of embodiments thereof, by way of example only, with reference to the accompanying drawings. Also, various embodiments of the aspects described in the preceding paragraphs will be apparent from the appended claims, the following description and/or the accompanying drawings. It should be understood, however, that the present invention is not limited to the arrangements and instrumentality shown in the attached drawings.

DETAILED DESCRIPTION OF CERTAIN EXAMPLES

Although the following discloses example methods, systems, articles of manufacture, and apparatus including, among other components, software executed on hardware, it should be noted that such methods and apparatus are merely illustrative and should not be considered as limiting. For example, it is contemplated that any or all of these hardware and software components could be embodied exclusively in hardware, exclusively in software, exclusively in firmware, or in any combination of hardware, software, and/or firmware. Accordingly, while the following describes example methods, systems, articles of manufacture, and apparatus, the examples provided are not the only way to implement such methods, systems, articles of manufacture, and apparatus.

When any of the appended apparatus claims are read to cover a purely software and/or firmware implementation, in at least one embodiment, at least one of the elements is hereby expressly defined to include a tangible medium such as a memory, DVD, CD, etc., storing the software and/or firmware.

Referring to the drawings, there is shown a gaming device having a game controller configured to employ one of a plurality of game state identifiers associated with respective ones of a plurality of game states to enable a game to be restored or to restore a game. Advantageously, the game state identifiers allow the game controller to easily duplicate game states when enabling a game to be restored. This allows players to restore a game at a later time, for example, to access game features previously unlocked in the game.

In certain embodiments, the gaming device is provided as part of a gaming system, where the game controller also relies on a session identifier from a session server. The session identifier provides a simple yet effective way of controlling the number of times a game may be restored, typically so it can only be restored once.

It is envisaged that a game state corresponds to a particular stage of a game. Persons skilled in the art will appreciate that a game state need not correspond only to the end or beginning of a stage of a game and that a game state may correspond to any point of a game. For example, a game state may correspond to the middle of a game stage where a new game feature is unlocked.

It is envisaged that a predetermined plurality of game state identifiers are associated with respective ones of the plurality of game states. It is envisaged that each game state is associated with a game state identifier by a game state mapper configured to map the game state to the game state identifier. Persons skilled in the art will appreciate that the game state mapper may be implemented by a processor of a computer based on computer program code stored in a memory or other tangible storage medium. Herein the term "processor" is used to refer generically to any device that can process game instructions and may include: a microprocessor, microcontroller, programmable logic device or other computational device, a general purpose computer (for example, a PC) or a server.

General Construction of the Gaming Device

In an embodiment, the gaming device is a stand alone gaming machine wherein all or most components for enabling restoration of games or for restoring games are present in a player operable gaming machine.

The gaming device has several core components. At the broadest level, the core components are a player interface 50 and a game controller 60 as illustrated in FIG. 1. The player interface is arranged to enable manual interaction between a player and the gaming device and for this purpose includes the input/output components for the player to enter instructions to play a game, observe game outcomes, to enable restoration of a game, or to restore a game.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to enable a player to input/output instructions for enabling the restoration of a game or for restoring a game), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. As discussed earlier, a "processor" may be any device that may be arranged or configured to process game play instructions in accordance with game play rules and may include: a microprocessor, microcontroller, programmable logic device or other computational device, a general purpose computer (e.g. a PC) or a server.

Figure 2:
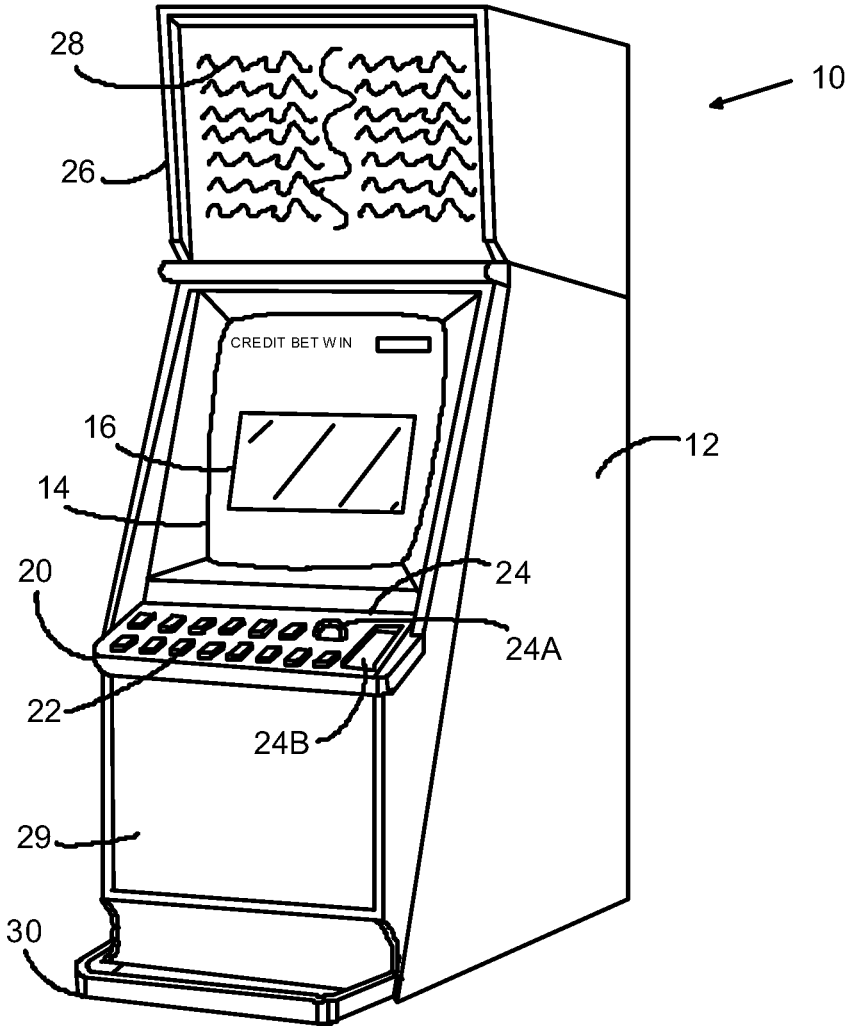
FIG. 2 is a perspective view of a stand alone gaming device.

A gaming device in the form of a stand alone gaming machine 10 is illustrated in FIG. 2. The gaming machine 10 includes a console 12 having a display 14 on which are displayed representations of a game 16 that can be played by a player. Although not illustrated, the gaming machine also includes readers/printers for a player to insert a ticket and/or to retrieve a ticket printed by the gaming machine, a keypad for a player to enter game restoration information and a transmitter for sending out game restoration information. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
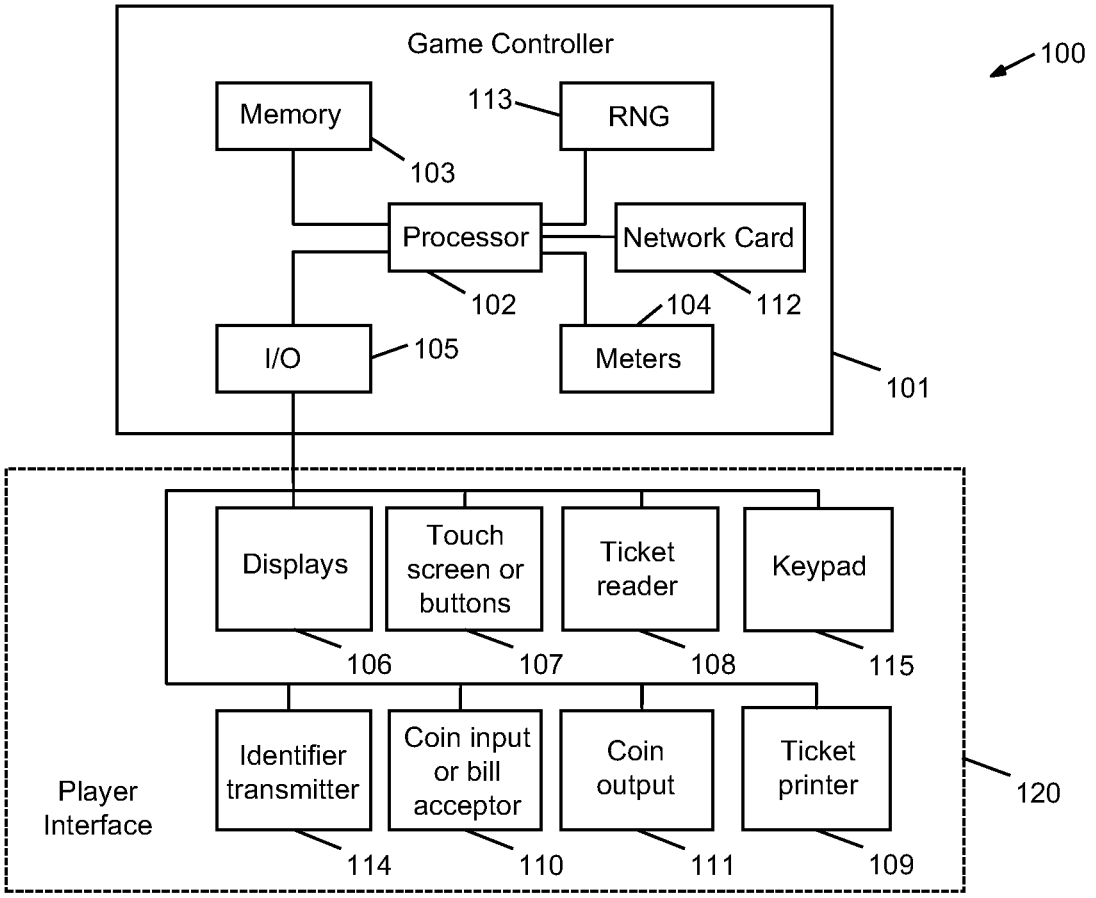
FIG. 3 is a block diagram of the functional components of a gaming device.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes game restoration devices that communicate with the game controller 101. These include a ticket printer 109, a ticket reader 108, an identifier transmitter 114 and a keypad 115. In addition, the player interface also comprise peripheral devices including one or more displays 106, a touch screen and/or buttons 107 (which provide a game play mechanism), a bill acceptor and/or coin input mechanism 110 and a coin output mechanism 111. Additional hardware may be included as part of the gaming machine 100, or hardware may be omitted based on the specific implementation. For example, while buttons or touch screens are typically used in gaming machines to allow a player to place a wager and initiate a play of a game any input device that enables the player to input game play instructions may be used.

In addition, the gaming machine 100 may include a communications interface, for example a network card 112. The network card may, for example, send requests for information or other information to a session server and receive requests for information or other information from a session server.

Figure 4:
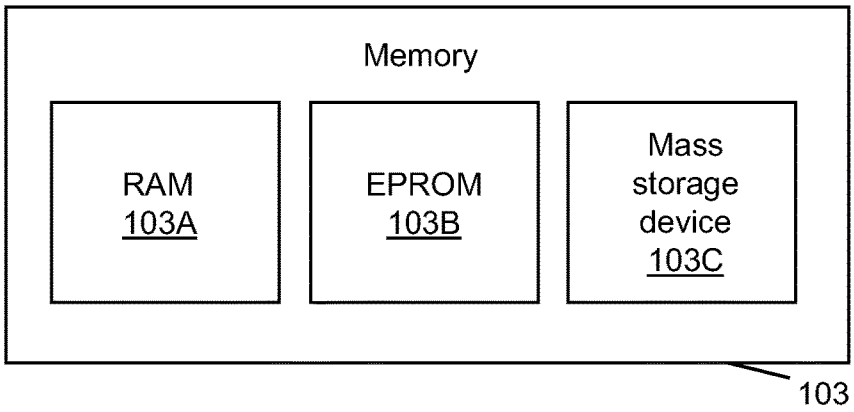
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

General Construction of the Gaming Device as Part of a Gaming System

In another embodiment, the gaming device is part of a gaming system wherein some of the components for enabling restoration of games or restoring games are present in a player operable gaming machine and some of the components for implementing the game are located remotely relative to the gaming machine. For example, some of the steps for enabling the restoration of a game may be executed on a player operable gaming machine and some of the steps for restoring a game may be executed remotely by a session server.

In addition, it will be understood that other arrangements are envisaged. For example, a gaming system may be provided wherein a gaming machine is networked to a session server and the respective functions of the gaming machine and the gaming server are selectively modifiable. For example, the gaming machine, although part of the gaming system, may operate in stand alone gaming machine mode depending on the game being played, operating conditions, and so on. Other variations will be apparent to persons skilled in the art.

Figure 5:
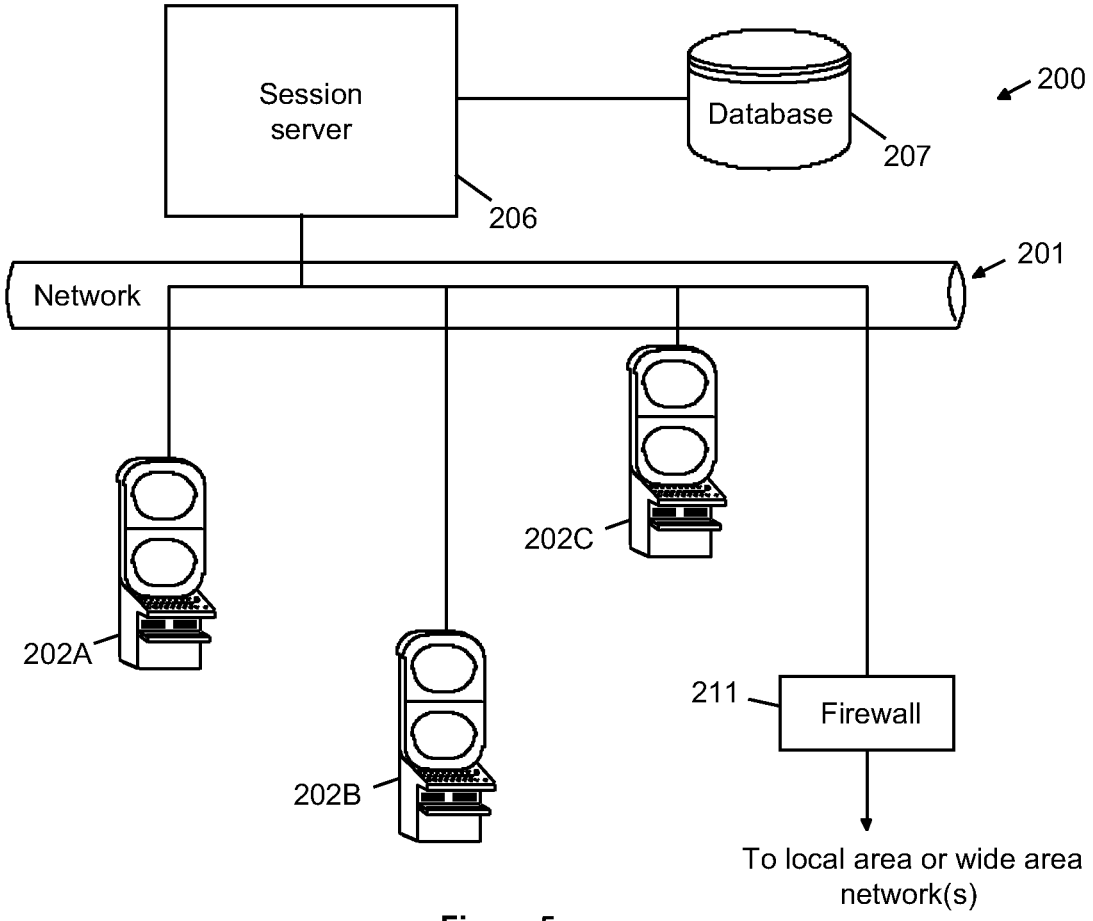
FIG. 5 is a schematic diagram of a gaming system.

FIG. 5 shows a gaming system 200 in accordance with an embodiment. The gaming system 200 includes a network 201, which for example may be an Ethernet network. Gaming machines 202A, 202B, 202C in FIG. 5 are connected to the network 201. The gaming machines 202A, 202B, 202C each provide a player operable interface and may be the same as the gaming machines 10,100 shown in FIGS. 2 and 3, or may have simplified functionality depending on the requirements for enabling restoration of games and for restoring games. While gaming machines 202A, 202B, 202C are illustrated as being individually connected to the network 201, banks of two or more gaming machines are also envisaged.

In FIG. 5, there is also illustrated a session server 206 for administering session identifiers that are stored in a database 207. As discussed earlier, these session identifiers may be used together with the game state identifiers to enable the restoration of a game or to restore a game played in any one of the gaming machines 202A, 202B, 202C. In FIG. 5, the session server 206 is illustrated as a central server that communicates with all of the gaming machines 202A, 202B, 202C.

The gaming system 200 may communicate with other gaming systems, other local networks, for example a corporate network, and/or a wide area network such as the Internet, for example through a firewall 211.

Persons skilled in the art will appreciate that in accordance with known techniques, the session server 206 need not be centralized and that the functionality at the server side of the network may be distributed over a plurality of different computers. For example, elements may be run as a single "engine" on one server or a separate server may be provided. That is, the session server can be implemented in a distributed fashion wherein the gaming machines are connected to separate session servers each of which is able to communicate with the database 207. It is also envisaged that the database 207 itself may be implemented in a distributed fashion. For example, a central session server 206 can communicate with multiple databases so that some of the session identifiers are stored in one database and the other session identifiers are stored in another database.

Further Detail of the Gaming System

Figure 6:
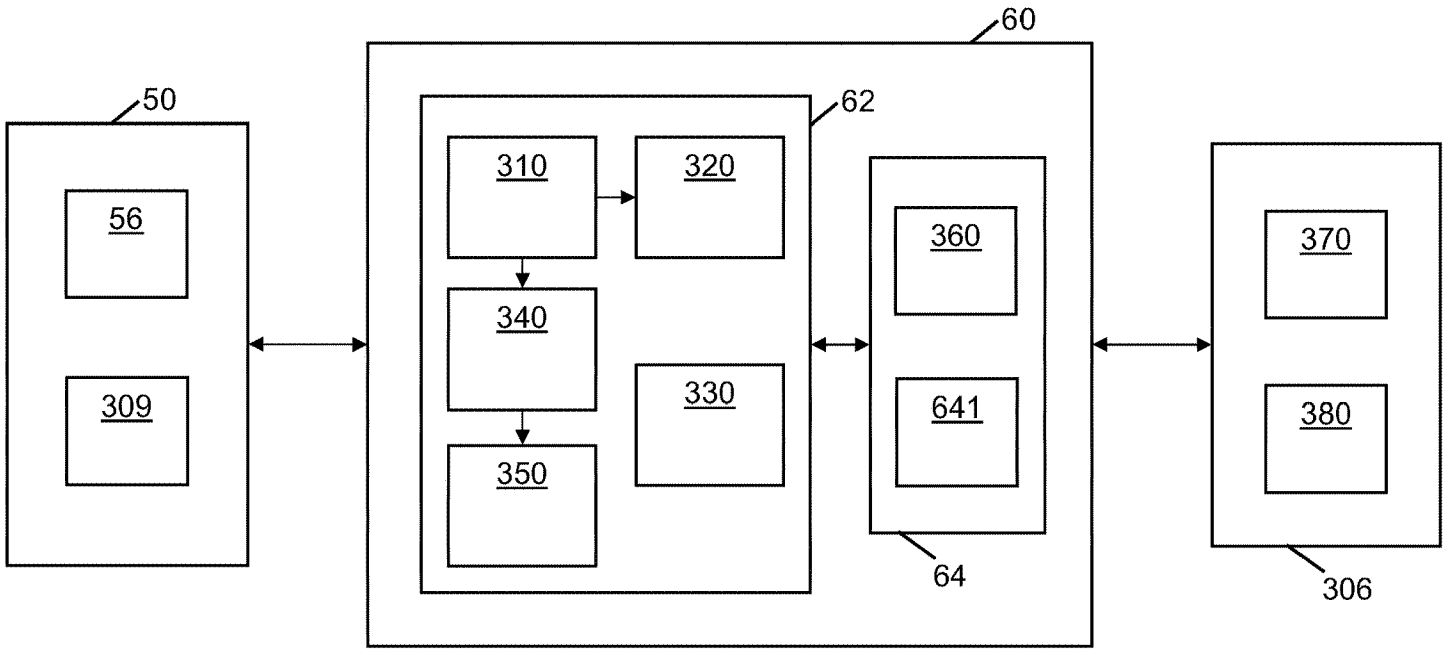
FIG. 6 is a block diagram of a gaming system.

FIG. 6 illustrates, in an embodiment, the game controller of a gaming device. In FIG. 6, the game controller 60 is shown implementing a number of modules to enable the restoration of a game. Persons skilled in the art will appreciate that the modules are based typically on program code 641 and data stored in memory 64. Persons skilled in the art will also appreciate that the modules are implemented typically using processor 62 but that some of the modules could be implemented in some other way, for example by a dedicated circuit.

In FIG. 6, the modules include a restoration request receiver 310 which operates in response to a player's operation of player interface 50 by having the player operate an input device 56 (e.g. pressing the touch screen and/or one of more buttons) to receive a request for subsequent restoration of a game. The restoration request receiver 310 is also arranged to communicate the request for subsequent restoration of a game to a session identifier requestor 320 and a game state identifier selector 340. The session identifier requestor 320 is arranged to make a request for a session identifier from a session server 306. In an embodiment, this request for a session identifier can be transmitted through a network via a network card of a gaming device. The session server 306 is arranged to receive this request. A session identifier generator 370 is arranged to generate a session identifier. Persons skilled in the art would appreciate that this can be done in a variety of ways (for example by generating a pseudo-random number sequence) and that the session identifier can be of a variety of lengths (for example, a 16 bit sequence) and/or be in different format (for example, a hexadecimal sequence). The session server 306 is arranged to output the session identifier upon receiving this request to a session identifier issuer 330. The session generator 306 is also arranged to transmit the newly generated session identifier to a session identifier database 380 to update the database. The session identifier database 380 is arranged to store the session identifiers that have been issued. The session identifier issuer 330 is arranged to issue the session identifier to the player interface 50.

The game state identifier selector 340 is arranged to select one of a plurality of game state identifiers associated with respective ones of a plurality of game states based on the current game state presented at the gaming device. In this embodiment, the game state identifier selector 340 is arranged to select a game state identifier from a game state identifier database 360. The game state identifier database 360 is arranged to store a predetermined set of game state identifiers corresponding to various game states. The game state identifier selector 340 is arranged so that the selected game state identifier can be communicated to a game state issuer 350 which is arranged to issue the game state identifier to the player interface 50.

The player interface 50 is arranged so that either the session identifier or the game state identifier or both the session identifier and the game state identifier can be output to a user. In this embodiment, a ticket printer 309 is used to output the session identifier and/or the game state identifier by printing a ticket comprising either the session identifier or the game state identifier or both the session identifier and the game state identifier. In an alternative embodiment, either or both the session identifier and/or the game state identifier can be output to a user by an identifier transmitter which transmits a Short Messaging Service (SMS) message comprising either the session identifier or the game state identifier or both the session identifier and the game state identifier. Typically, users are output with both a game state identifier and a session identifier.

Figure 7:
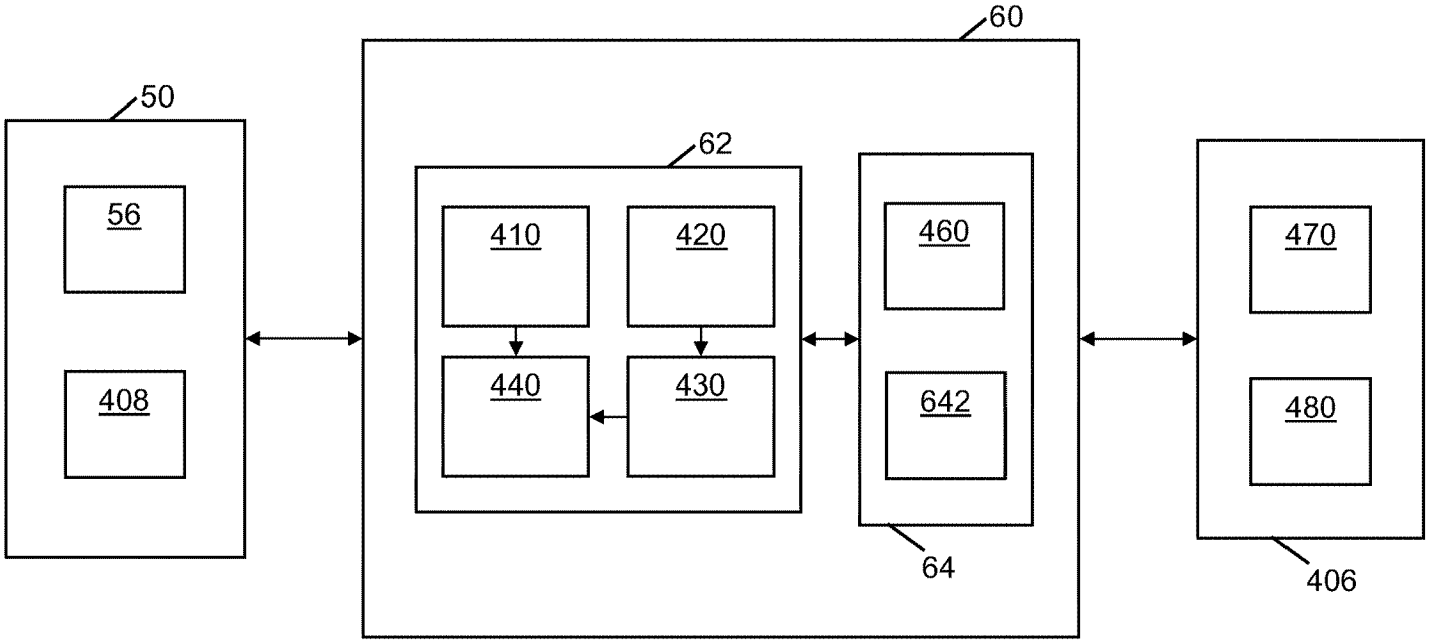
FIG. 7 is a block diagram of a gaming system.

FIG. 7 illustrates the game controller 60 implementing a set of modules to restore a game. As with FIG. 6, persons skilled in the art will appreciate that the modules are typically implemented by processor 62 based on program code 642 stored in memory 64 but that some of the modules could be implemented in some other way, for example by a dedicated circuit.

The modules include a game state identifier receiver 410 arranged to receive a game state identifier from the player interface 50. In this embodiment, a game state identifier is received when a player inserts a ticket comprising the game state identifier into a ticket reader 408. Alternatively, a game state identifier may be received when a player enters the game state identifier on one of the input devices 56 of the gaming device (e.g. by entering the game state identifier on a keypad). Person skilled in the art will appreciate that an input device can be used in various ways so as to allow a game state identifier to be received; for example, a "virtual" keypad on the touch screen of the gaming device can be used to enter the game state identifier.

The modules of the game controller 60 also include a session identifier receiver 420 arranged to receive a session identifier from the player interface 50. In this embodiment, a session identifier is received when a player inserts a ticket comprising the session identifier into the ticket reader 408. It is envisaged that a ticket can comprise either the game state identifier or the session identifier or both the session identifier and the game state identifier. In an alternative embodiment, the session identifier can be received when a player enters the session identifier using one of the input devices 56. It is envisaged that a player may enter a game state identifier (or a session identifier) using one of the input devices 56 but use a ticket to provide the session identifier (or game state identifier).

The session identifier receiver 420 is arranged so that the session identifier received from the player interface 50 may be communicated to the session identifier communicator 430 so as to determine whether the session identifier received from the player interface 50 has been previously used to restore a game. In an embodiment, this communication is transmitted through a network via the network card. In this embodiment, a session identifier verifier 470 is arranged to determine whether the session identifier received from the player interface 50 has been previously used to restore a game by searching through a session identifier database 480 which stores the session identifiers that have been issued by not previously used to restore a game. The session identifier communicator 430 is arranged so that the result of this determination can be communicated to a game state restorer 440. Person skilled in the art will appreciate that the determination of whether the session identifier received from the player interface 50 has been previously used to restore a game can also be done in a variety of ways and can depend on how the session identifier was issued. The session identifier communicator 430 is also arranged to communicate to the game state restorer 440 that an otherwise invalid session identifier was received from the player interface 50. In this embodiment, once the session identifier verifier 470 determines that the session identifier from the player interface 50 has not been previously used to restore a game, it deletes the session identifier listed in the session identifier database 480 so that the same session identifier cannot be used in the future to restore another game. Persons skilled in the art would appreciate that the session identifier verifier need not always restrict each session identifier to be used only once. For example, each session identifier stored in the session identifier database can be associated with a count value that is decremented each time a session identifier is used to restore a game. In this way, each session identifier can be used to restore a game a plurality of times instead of just once.

The game state restorer 440 is arranged to restore a game at the gaming device to one of a plurality of game states associated with respective ones of a plurality of game state identifiers based on the game state identifier communicated from the game state identifier receiver 410 if the game state restorer 440 receives from the session identifier communicator 430 the determination that the session identifier has not yet been used and is otherwise valid. In this embodiment, the game state restorer 440 is arranged to restore a game by restoring the game to the game state that is associated with the game state identifier communicated from the game state identifier receiver 410.

Persons skilled in the art will appreciate that a game controller will typically implement not only the modules of FIG. 6 but also the modules of FIG. 7. Accordingly, a game controller may be used both to enable restoration of games and to restore games.

Figure 8:
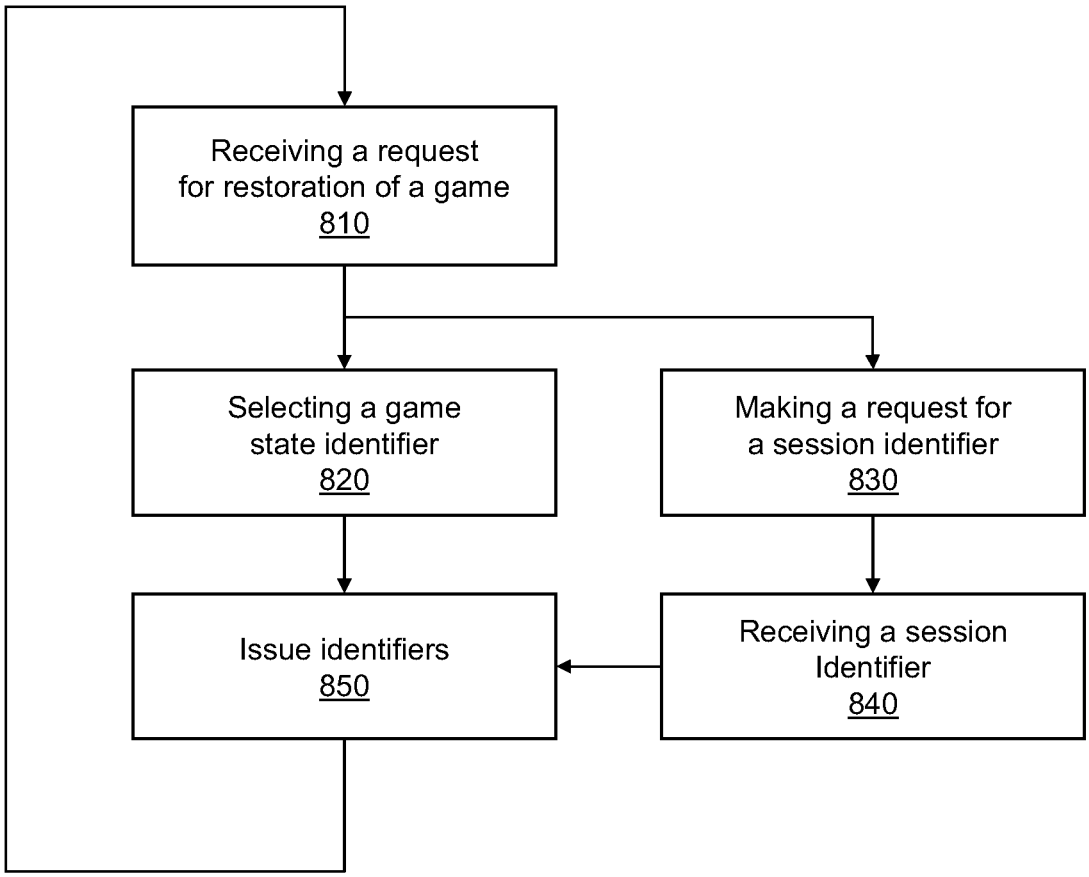
FIG. 8 is a flow chart of an embodiment.
Figure 9:
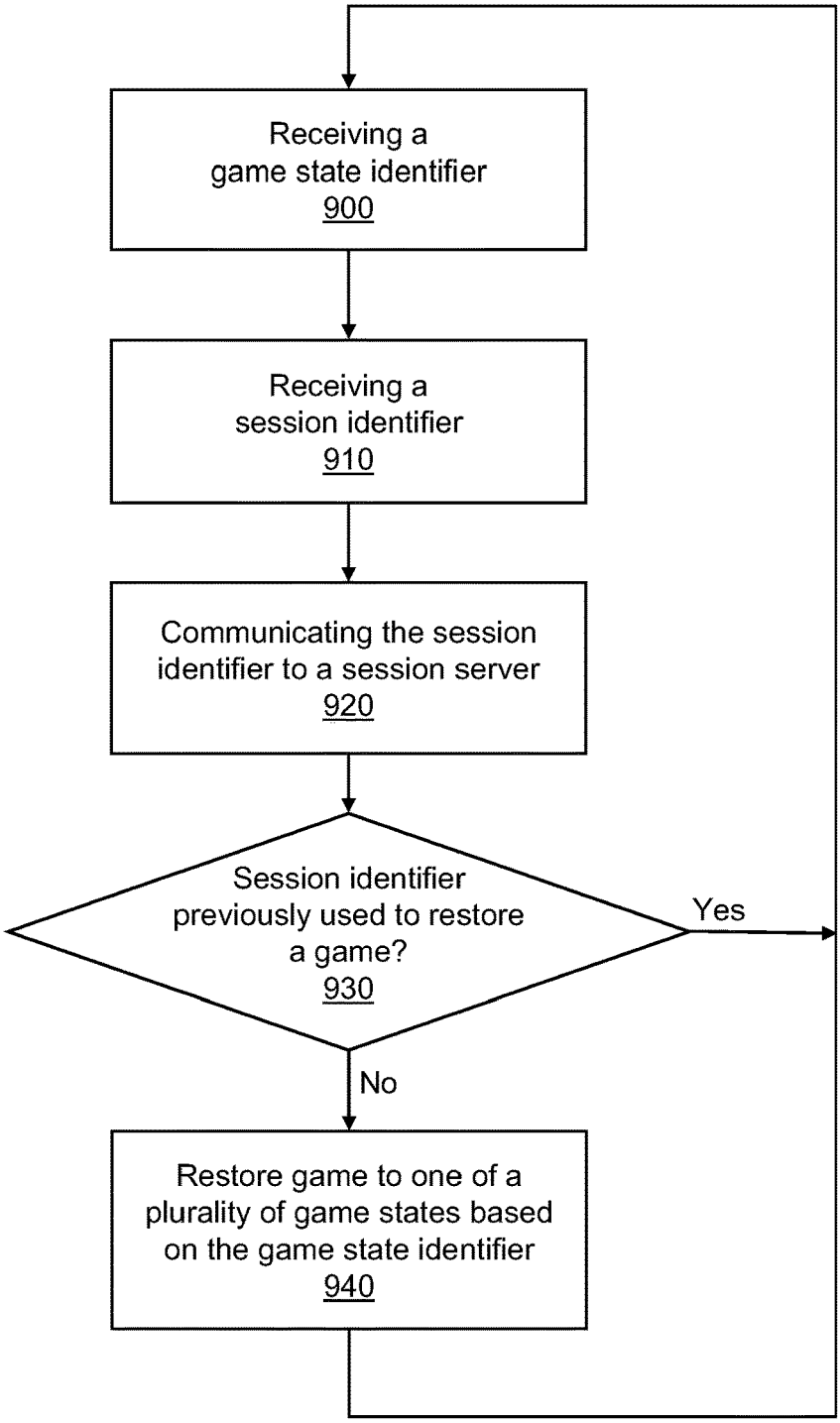
FIG. 9 is a flow chart of an embodiment.

FIGS. 8 and 9 are flow diagrams representative of example machine readable instructions that can be executed to implement the example systems shown in FIGS. 1-7 and/or portions of one or more of those systems. The example process(es) of FIGS. 8 and 9 can be performed using a processor, a controller and/or any other suitable processing device. For example, the example process(es) of FIGS. 8 and 9 can be implemented using coded instructions (e.g., computer readable instructions) stored on a tangible computer readable medium such as a flash memory, a read-only memory (ROM), and/or a random-access memory (RAM). As used herein, the term tangible computer readable medium is expressly defined to include any type of computer readable storage and to exclude propagating signals. Additionally or alternatively, the example process(es) of FIGS. 8 and 9 can be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Alternatively, some or all of the example process(es) of FIGS. 8 and 9 can be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example process(es) of FIGS. 8 and 9 can be implemented manually or as any combination(s) of any of the foregoing techniques, for example, any combination of firmware, software, discrete logic and/or hardware. Further, although the example process(es) of FIGS. 8 and 9 is described with reference to the flow diagram of FIGS. 8 and 9, other methods of implementing the process(es) of FIGS. 8 and 9 can be employed. For example, the order of execution of the blocks can be changed, and/or some of the blocks described can be changed, eliminated, sub-divided, or combined. Additionally, any or all of the example process(es) of FIGS. 8 and 9 can be performed sequentially and/or in parallel by, for example, separate processing threads, processors, devices, discrete logic, circuits, etc.

The method of enabling restoration of games is outlined in FIG. 8. First, a request for enabling restoration of a game is received at a gaming device 810. This request may be initiated by a player using a touch screen and/or buttons of the gaming device during play of a game. After the request is received, one of a plurality of game state identifiers (each associated with a respective one of plurality of game states) is selected based on the game state currently being presented at the gaming device 820. A request for a session identifier from the session server is also made 830 after the request for enabling restoration is received. After a session identifier is received from the session server 840, the selected game state identifier and the received session identifier is then issued 850 and a ticket printer prints a ticket comprising the game identifier and session identifier. Once the game state identifier is printed, the game presented at gaming machine is stopped and a database is updated to reflect that the particular session identifier has been issued.

Person skilled in the art will appreciate that the game identifier and/or session identifier can be issued in other ways. For example, the session identifier can be issued by requesting the player to enter his/her mobile phone number on the keypad of a gaming device that is connected via a network to a SMS Gateway and transmitting from the SMS Gateway a Short Messaging Service (SMS) message comprising the game identifier and/or session identifier to the player's mobile phone, where it will be stored in a memory of the phone.

It is also envisaged that a player may input player information (such as a player's loyalty membership details) via a keypad, touch screen and/or buttons to register the ticket before or after the ticket is printed by a ticket printer so that the player can restore a game even if he has lost the ticket.

Additionally, the ticket, game state identifier and/or session identifier may also be associated with a pin or password so that only the player is able to use the ticket, game state identifier and/or session identifier.

The method of restoring games corresponding to the above method of enabling restoration of games is illustrated in FIG. 9. A game state identifier is first received at a gaming device 900. This game state identifier can be received by having a player enter the game state identifier manually using a keypad of the gaming device or by having the player insert a valid ticket into the ticket reader of the gaming device. Next a session identifier is received 910. The session identifier can also be received via the keypad or the ticket reader of the gaming device. This can involve entering player information (if the player lost his ticket) and/or entering a pin or associated password using the keypad, touch screen and/or buttons. Both the game state identifier and the session identifier can be received simultaneously or one can be received before the other. The session identifier is then communicated to a session server 920. Upon receiving this communication, a determination as to whether the session identifier was previously used to restore a game is made 930. It is envisaged that the session identifier or the game state identifier may also be validated before this determination is carried out. If it is determined that the session identifier was previously used or either or both the session identifier or the game state identifier are invalid identifiers, the gaming device reverts back to the state of waiting to receive a game state identifier. If it is determined that the session identifier was not previously used and that both the game state identifier and the session identifier are valid, the gaming device then proceed to restore a game to one of the plurality of game states based on the game state identifier 940.

Further aspects of the method will be apparent from the above description of the gaming system. Persons skilled in the art will also appreciate that the method could be embodied in program code. The program code could be supplied in a number of ways, for example on a tangible computer readable medium, such as a disc or a memory (for example, that could replace part of memory 103) or as a data signal (for example, by transmitting it from a server).

Similarly, it will be appreciated that the identifiers can be supplied on any appropriate tangible data carrier, such as by writing them to a magnetic swipe card, storing them in a memory (including transmitting identifiers to a device having a memory) etc.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the embodiments of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. It will be understood that the invention disclosed and defined in this specification extends to all alternative combinations of two or more of the individual features mentioned or evident from the text or drawings. All of these different combinations constitute various alternative aspects of the invention.

The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

The invention claimed is:

1. A method for enabling restoration of games, comprising:

receiving, at a first gaming device including a first credit input mechanism configured to receive a credit input from a player, the first credit input mechanism comprising at least one of a coin input chute, a bill collector, a card reader, or a ticket reader, a request for subsequent restoration of a game;

storing, in a game state identifier database, a plurality of game state identifiers, each game state identifier associated with one or more game states of the game;

identifying, by a first game controller of the first gaming device, a current game state of the game presented on a display of the first gaming device;

selecting, by the first game controller, a game state identifier of the plurality of game state identifiers associated with the current game state;

requesting, by the first game controller, a session identifier from a session server through a network, wherein the session identifier is generated based upon a random number and independently of the game state identifier in response to the requesting;

issuing, by the first game controller, at the first gaming device, the game state identifier and the session identifier;

registering, by the first game controller, at least one of the game state identifier and the session identifier with a player account of the player, whereby the player is enabled to restore the game using only the player account if desired by the player;

receiving the game state identifier and the session identifier at a second game controller of a second gaming device, the second gaming device including a second credit input mechanism configured to receive a credit input from the player, the second credit input mechanism comprising at least one of a coin input chute, a bill collector, a card reader, or a ticket reader;

communicating, by the second game controller, the session identifier from the second gaming device to the session server through the network;

receiving, by the second game controller, a communication that the session identifier is valid from the session server through the network;

identifying, by the second game controller, the current game state of the game using the game state identifier; and restoring, by the second game controller, the game to the current game state on the second gaming device.

2. The method as claimed in claim 1 further comprising mapping each of the one or more game states to a game state identifier of the plurality of game state identifiers.

3. The method as claimed in claim 1, wherein issuing the game state identifier comprises printing a ticket including the game state identifier.

4. The method as claimed in claim 1, wherein issuing the game state identifier comprises transmitting a Short Messaging Service (SMS) message including the game state identifier to a mobile communication device of the player.

5. The method as claimed in claim 1 further comprising:

receiving, by the second game controller, a communication that the session identifier is invalid from the session server through the network; and restoring, by the second game controller and in response to receiving the communication that the session identifier is invalid, the second gaming device to a state of waiting to receive a game state identifier.

6. The method as claimed in claim 5, wherein the communication that the session identifier is invalid indicates that the session identifier was previously used to restore a game.

7. The method as claimed in claim 1 further comprising:
associating, by the session server, the session identifier with an initial count value; and
decrementing, by the session server, the initial count value in response to the restoring the game to the current game state on the second gaming device, whereby the game is capable of being restored from the session identifier a number of times corresponding to the initial count value, and whereby the initial count value is decremented each time the session identifier is used to restore the game until the initial count value is decremented to zero.

8. The method as claimed in claim 7 further comprising:
receiving, by the second game controller, a decremented count value; and
restoring, by the second game controller and in response to receiving the decremented count value, the game unless the decremented count value is equal to zero.

9. The method as claimed in claim 1 further comprising:
receiving, by the first game controller and prior to issuing the the game state identifier and the session identifier, a mobile telephone number from the player; and
transmitting, by the first game controller, a Short Messaging Service (SMS) message including at least one of the game state identifier or the session identifier to a mobile communication device of the player associated with the mobile telephone number.

10. The method as claimed in claim 1 further comprising:
associating, by the first game controller, at least one of the game state identifier or the session identifier with at least one of a personal identification number (PIN) or password; and
requesting, by the second game controller, at least one of the PIN or password prior to restoring the game to the current game state on the second gaming device.

11. A game controller for a gaming device, the gaming device including a credit input mechanism configured to receive a credit input from a player of the gaming device, the credit input mechanism comprising at least one of a coin input chute, a bill collector, a card reader, or a ticket reader, the game controller configured to execute instructions stored in a memory, which when executed, cause the game controller to at least:
receive a request for subsequent restoration of a game;
identify a current game state of the game presented on a display of the gaming device;
select a game state identifier from a plurality of game state identifiers, the game state identifier associated with the current game state, the plurality of game state identifiers associated with respective game states and stored in a game state identifier database;
request a session identifier from a session server through a network, wherein the session identifier is generated based upon a random number and independently of the game state identifier in response to the request;
issue the game state identifier and the session identifier; and
register at least one of the game state identifier and the session identifier with a player account of the player, whereby the player is enabled to restore the game using only the player account if desired by the player.

12. The game controller as claimed in claim 11, wherein the instructions, when executed, further cause the game controller to map each of the respective game states to a game state identifier of the plurality of game state identifiers.

13. The game controller as claimed in claim 11, wherein the instructions, when executed, further cause the game controller to communicate with a ticket printer for printing a ticket including the game state identifier.

14. The game controller as claimed in claim 11, wherein the instructions, when executed, further cause the game controller to communicate with an identifier transmitter for transmitting a Short Messaging Service (SMS) message including the game state identifier to a mobile communication device of the player.

15. A gaming system comprising:
a first gaming device comprising:
a first credit input mechanism configured to receive a credit input from a player of the first gaming device, the first credit input mechanism comprising at least one of a coin input chute, a bill collector, a card reader, or a ticket reader;
a first display configured to present play of a game to the player; and
a first game controller configured to:
receive a request for subsequent restoration of the game;
store, in a game state identifier database, a plurality of game state identifiers, each game state identifier associated with one or more game states of the game;
identify a current game state of the game presented on the first display;
select a game state identifier of the plurality of game state identifiers associated with the current game state;
request a session identifier from a session server through a network, wherein the session identifier is generated based upon a random number and independently of the game state identifier in response to the request;
issue the game state identifier and the session identifier; and
register at least one of the game state identifier and the session identifier with a player account of the player, whereby the player is enabled to restore the game using only the player account if desired by the player; and
a second gaming device comprising:
a second credit input mechanism configured to receive a credit input from the player, the second credit input mechanism comprising at least one of a coin input chute, a bill collector, a card reader, or a ticket reader;
a second display configured to present play of the game to the player; and
a second game controller configured to:
receive the game state identifier and the session identifier;
communicate the session identifier to the session server through the network;
receive a communication that the session identifier is valid from the session server through the network;
identify the current game state of the game using the game state identifier; and
restore the game to the current game state.

16. A gaming machine comprising:
a cabinet;
a display mounted within the cabinet and configured to present play of a game to a player;
a credit input mechanism configured to receive a credit input from the player, the credit input mechanism comprising at least one of a coin input chute, a bill collector, a card reader, or a ticket reader; and a game controller in data communication with the credit input mechanism and the display, the game controller configured to execute instructions stored in a memory, which when executed, cause the game controller to at least:

receive a request for subsequent restoration of the game;

identify a current game state of the game presented on the display at the gaming machine;

select a game state identifier from a plurality of game state identifiers, the game state identifier associated with the current game state, the plurality of game state identifiers associated with respective game states and stored in a game state identifier database;

request a session identifier from a session server through a network, wherein the session identifier is generated based upon a random number and independently of the game state identifier in response to the request;

issue the game state identifier and the session identifier; and register at least one of the game state identifier and the session identifier with a player account of the player, whereby the player is enabled to restore the game using only the player account if desired by the player.

17. A game controller for a gaming device, the gaming device including a credit input mechanism configured to receive a credit input from a player of the gaming device, the credit input mechanism comprising at least one of a coin input chute, a bill collector, a card reader, or a ticket reader, the game controller configured to execute instructions stored in a memory, which when executed, cause the game controller to at least:

store, in a game state identifier database, a plurality of game state identifiers, each game state identifier associated with one or more game states of a game presented on a display of the gaming device;

receive, in response to a first request for restoration of the game, a first game state identifier of the plurality of game state identifiers and a first session identifier;

communicate the first session identifier from the gaming device to a session server through a network and receive a communication from the session server that the first session identifier is valid;

identify a previous game state of the game using the first game state identifier;

restore the game to the previous game state on the gaming device;

conduct the game from the previous game state to a current game state;

receive a request for subsequent restoration of the game;

identify the current game state of the game presented on the display of the gaming device;

select a second game state identifier of the plurality of game state identifiers associated with the current game state;

request a second session identifier from the session server through the network, wherein the second session identifier is generated based upon a random number and independently of the second game state identifier in response to the request;

issue the second game state identifier and the second session identifier; and register at least one of the second game state identifier and the second session identifier with a player account of the player, whereby the player is enabled to restore the game using only the player account if desired by the player.

* * * * *